US006971217B2

(12) United States Patent
Luxem et al.

(10) Patent No.: US 6,971,217 B2
(45) Date of Patent: Dec. 6, 2005

(54) METHOD AND DEVICE FOR CONTROLLING A WRAPPING MACHINE FOR PRINTED PRODUCTS

(75) Inventors: Heiner Philipp Luxem, Durham, NH (US); Richard Craig Meyer, Alfred, ME (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/768,367

(22) Filed: Jan. 30, 2004

(65) Prior Publication Data

US 2004/0231290 A1 Nov. 25, 2004

Related U.S. Application Data

(60) Provisional application No. 60/472,850, filed on May 23, 2003.

(51) Int. Cl.[7] ..... B65B 57/02

(52) U.S. Cl. ..... 53/396; 53/459; 53/55; 53/494; 198/341.03; 198/462.2

(58) Field of Search ..... 53/52, 64, 167, 53/203, 396–399, 580, 250, 251, 459, 469, 53/570, 494, 55, 57, 74; 198/341.03, 341.07, 198/464.2, 572, 577; B65B 57/16

(56) References Cited

U.S. PATENT DOCUMENTS

| | | | | |
|---|---|---|---|---|
| 3,607,547 A | * | 9/1971 | Kronseder | 156/351 |
| 3,908,815 A | * | 9/1975 | Carter | 198/341.07 |
| 4,135,346 A | * | 1/1979 | Rebsamen | 53/494 |
| 4,394,896 A | * | 7/1983 | McComas et al. | 198/341.06 |
| 4,514,963 A | * | 5/1985 | Bruno | 53/493 |
| 4,717,013 A | | 1/1988 | Reissmann et al. | 198/461 |
| 4,722,168 A | * | 2/1988 | Heaney | 53/450 |
| 4,974,824 A | * | 12/1990 | Kimbel et al. | 270/58.05 |
| 5,038,915 A | * | 8/1991 | Delsanto | 198/419.3 |
| 5,137,139 A | * | 8/1992 | Ruscello | 198/460.1 |
| 5,628,166 A | * | 5/1997 | Hannon | 53/459 |
| 5,884,458 A | * | 3/1999 | Alvarez | 53/553 |

FOREIGN PATENT DOCUMENTS

| | | |
|---|---|---|
| DE | 33 19 247 | 11/1984 |
| DE | 198 22 837 | 10/1999 |
| EP | 0 083 913 | 9/1985 |
| EP | 0 565 019 | 10/1993 |

OTHER PUBLICATIONS

Product Information on Magnapak Inserter and Wrapper from www.heidelberg.com website.

* cited by examiner

*Primary Examiner*—Stephen F. Gerrity
*Assistant Examiner*—Thanh Truong
(74) *Attorney, Agent, or Firm*—Davidson, Davidson & Kappel, LLC

(57) ABSTRACT

A method for controlling a wrapping machine for printed products that includes determining the size of an incoming gap in a printed product stream and controlling a speed of the wrapping machine as a function of the size of the incoming gap. The controlling step includes intentionally leaving, in the printed product stream in the wrapper machine, at least a single product gap corresponding to the incoming gap so as to create at least one empty bag. A newspaper finishing machine and controller are also provided.

14 Claims, 7 Drawing Sheets

METHOD AND DEVICE FOR CONTROLLING A WRAPPING MACHINE FOR PRINTED PRODUCTS

This claims the benefit of U.S. Provisional Patent Application No. 60/472,850, filed May 23, 2003 and hereby incorporated-by-reference herein.

BACKGROUND INFORMATION

The present invention relates generally to the graphic arts industry and more particularly to a method and device for controlling a wrapping machine, as well as to a newspaper finishing device having the device for controlling the wrapping machine.

After printing by a printing press, printed sheet material may collected to form a printed product, such as a newspaper. The collected sheet material may be collected by insertion into open sections, or by collation as separate individual sheets or sections that are placed side-by-side, or by both insertion and collation. The printed products may then transferred and conveyed in various manners, such as via gripper conveyor and a pin conveyor. A wrapping machine, also known as a wrapper, may wrap bags around the printed products, which then may be stacked.

FIG. 1 for example shows a MAGNAPAK finishing device for a newspaper printing press manufactured by Heidelberger Druckmaschinen AG. An inserter/collator 1 forms printed products, which are transferred by a gripper conveyor 2 to a pin conveyor 4 at a drop-off 3. The pin conveyor 4 conveys the printed products to a wrapping machine 5, which wraps the printed products for example using a bag. The wrapped printed products are transferred via a by-pass 6 to a stacker 7.

The wrapping machine 5 has a drive separate from that of the pin conveyor 4 and thus is mechanically decoupled from the pin conveyor, but the wrapping machine 5 follows the speed of the pin conveyor. The wrapping machine runs at, or with a speed offset above, the speed of the pin conveyor under normal running conditions. However, if gaps in the stream of printed products from the pin conveyor 4 occur, i.e. there is no product due to a misfeed in the collector 1, the wrapping machine 5 creates empty bags. For a single missing product, this creates little problem for the wrapping machine 5. However, when a gap of three or more products following one another occurs, the wrapping machine may create too many empty bags which may collect and can cause jams. In addition, extra waste is created.

To address this problem, the prior art device has a controller with a gap recovery system and a sensor to determine if a gap is present at the pin conveyor. As shown in FIG. 2, if a gap is present, the product B1 is transferred to the wrapping machine at a transfer step where the wrapping machine moves the product B1. The wrapping machine is then decelerated so that the wrapping machine stops within a cycle of the pin conveyor, i.e. if the pin conveyor moves at a speed V1 and has a pin spacing of D, within the time D/V1. The wrapping machine is then accelerated in the next cycle of the pin conveyor back to the speed of the pin conveyor, so that the gap had disappeared, product A1 now being conveyed right behind product B1. In other words product B1 moves a distance D in the time 2D/V1, for an average speed equal during this time equal to half of V1.

The acceleration and deceleration rates for this system are very high as the gap is reduced within two pin conveyor cycles, and may create splays in the printed product or jams in the wrapper at high operation rates.

A cycle of the pin conveyor is defined herein as the time it takes one printed product at an instant in time to reach the position at which the preceding printed product was located at that same instant in time during a running of the pin conveyor, i.e. if the pin conveyor speed is V1 and the pin spacing D, a time equal to D/V1.

BRIEF SUMMARY OF THE INVENTION

An object of the present invention is to provide a method and device for controlling a wrapping machine in which problems associated with incoming product gaps are reduced. An alternate or additional object of the present invention is to provide an improved newspaper finishing device having a wrapping machine.

The present invention provides a method for controlling a wrapping machine for printed products comprising the steps of:

determining a size of an incoming gap in a printed product stream; and controlling a speed of the wrapping machine as a function of the size of the incoming gap, the controlling step including intentionally leaving, in the printed product stream in the wrapper machine, at least a single product gap corresponding to the incoming gap so as to create at least one empty bag.

By intentionally producing an empty bag where the incoming gap was located, the speed of the wrapping machine may be controlled so that rapid acceleration and deceleration of the wrapping device can be avoided or minimized.

If the size of the gap exceeds a predetermined size, the controlling step may include reducing the size of the incoming gap.

If the size of the incoming gap is a single product, the speed of the wrapping machine may remain the same, and no deceleration or acceleration is needed.

If the size of the incoming gap is two products, and the wrapping machine is controlled to create one empty bag in response to an incoming gap, the wrapping machine need only be decelerated to an intermediate speed and then accelerated to the incoming product stream speed. The deceleration and acceleration forces are reduced.

If the size of the incoming gap is three products or more, and the wrapping machine is controlled to create one empty bag in response to an incoming gap, the wrapping machine can be decelerated to a stop in two pin conveyor cycles. The wrapping machine then may be accelerated to the pin conveyor speed in two pin conveyor cycles so that at least one single empty bag is created.

The deceleration preferably starts when a lead end of the printed product reaches the wrapping machine and the wrapping machine takes over movement of the printed product.

Preferably, the at least one single product gap remains a single product gap on the wrapping machine, so that the wrapper generates one empty bag. However, it is possible for the wrapping machine to create more empty bags, i.e. for a larger gap to remain on the wrapping machine, if the wrapping machine so permits.

The present invention also provides a method for controlling a wrapping machine for printed products comprising the steps of:

determining a size of an incoming gap in a printed product stream having a first speed; and controlling a speed of the wrapping machine as a function of the size of the incoming gap, the controlling step including in certain modes decelerating the wrapping machine from the first speed over more than a full printed product stream cycle so as to reduce the size of the incoming gap.

The slower deceleration advantageously reduces forces on the products.

The method may further include accelerating the wrapping machine to the first speed.

The size of the incoming gap is preferably reduced in the wrapping machine to the size of at least one printed product, and preferably to the size of exactly one printed product.

The wrapping machine may be decelerated to a full stop when the size of the incoming gap is three printed products or more.

The wrapping machine may be decelerated to a certain speed when the size of the gap is two printed products.

The present invention also provides a controller for controlling a wrapping machine for printed products, the controller including a first input for determining a speed of a printed product stream, a second input for determining a size of a gap in the printed product stream, and an output for controlling a speed of the wrapping machine, the controller controlling the speed of the wrapping machine as a function of the size of the incoming gap in at least some modes so as to reduce the incoming gap in the wrapping machine while still creating at least one empty bag in the wrapping machine.

The present invention also provides a newspaper finishing machine comprising:

a conveyor for conveying newspapers at a first speed; and a wrapping machine for wrapping the newspapers and capable of being driven at a different speed than the conveyor, at least one sensor for determining a size of a gap in the printed product stream entering the wrapping machine, and a controller for controlling a speed of the wrapping machine, the controller reducing the size of the gap, the controller controlling the speed of the wrapping machine as a function of the size of the incoming gap in at least some modes so as to reduce the incoming gap in the wrapping machine while still creating at least one empty bag in the wrapping machine.

DETAILED DESCRIPTION

Figure 1:
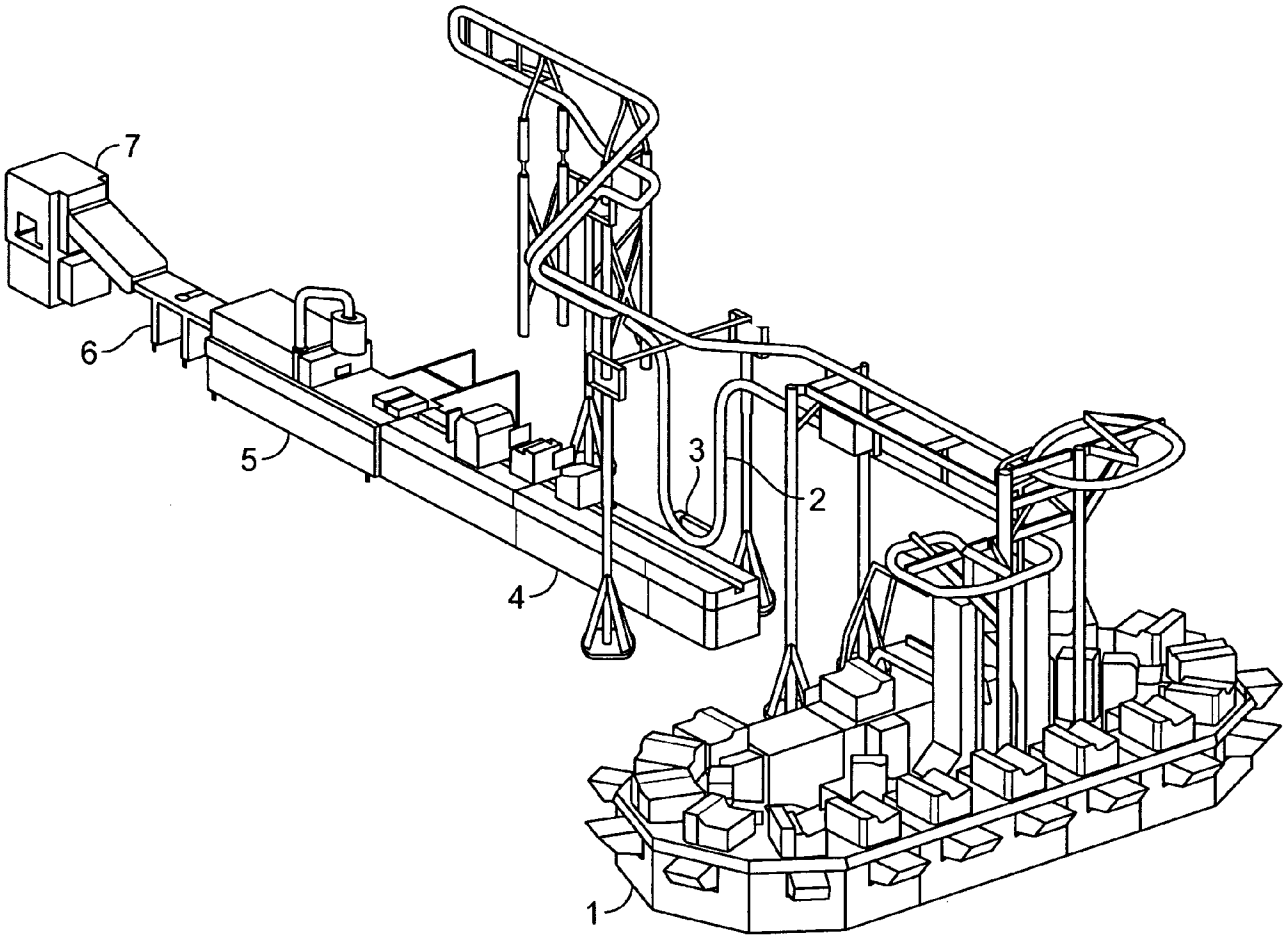
FIG. 1 (Prior Art)
FIG. 1 shows a prior art finishing device controlled according to the method shown in FIG. 2.
Figure 2:
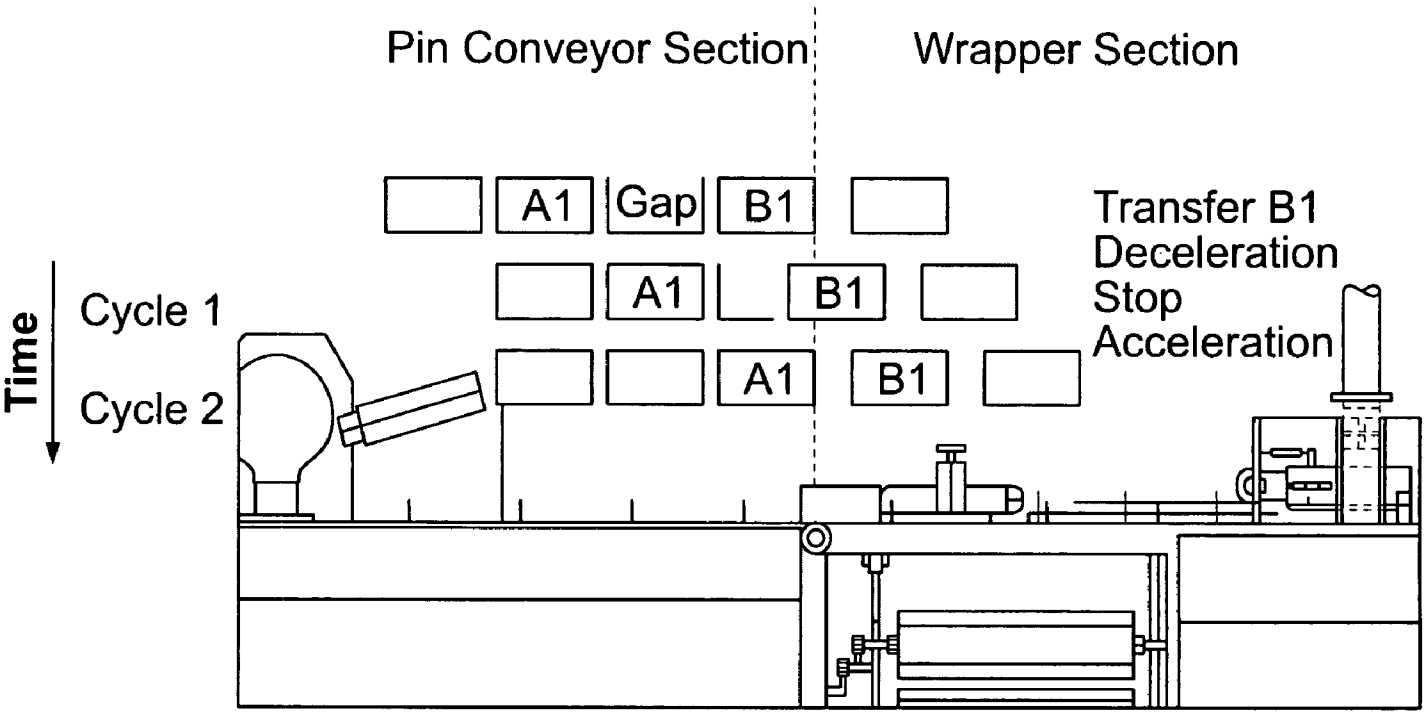
FIG. 2 (Prior Art)
FIG. 2 shows a schematic of the prior art gap recovery method of the FIG. 1 device.
Figure 3:
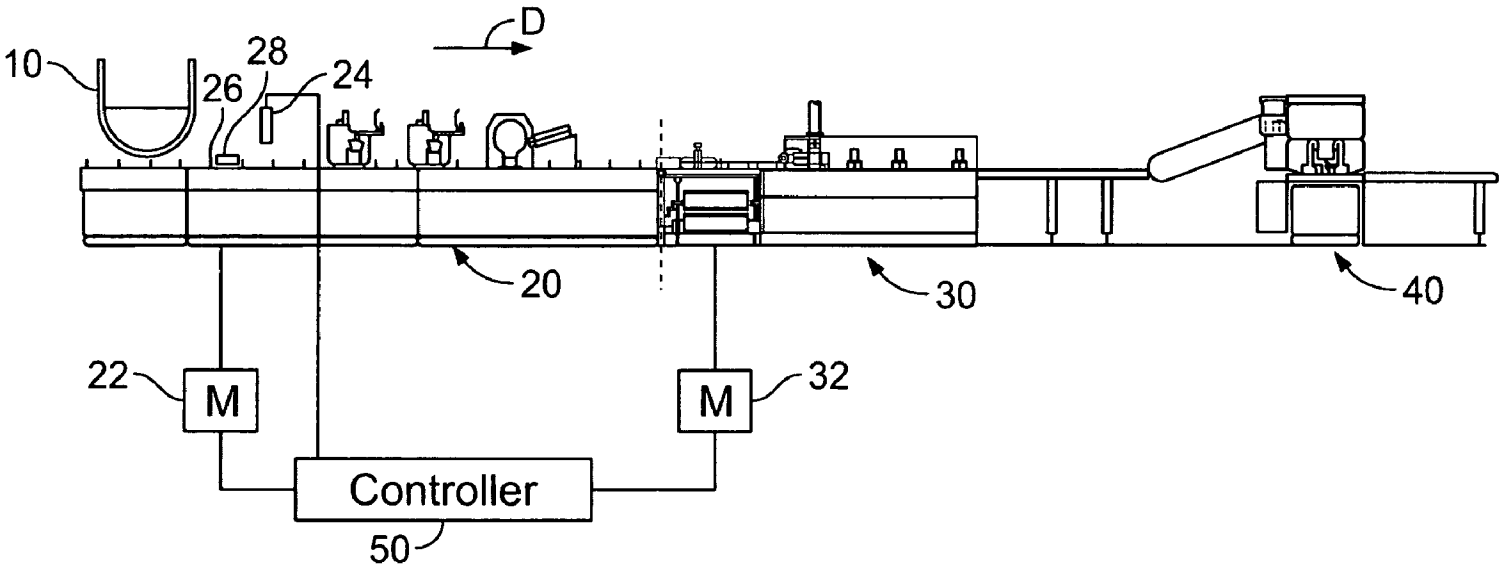
FIG. 3 shows a partial side view of the finishing machine with a controller according to the present invention.

FIG. 3 shows a finishing machine with a gripper conveyor 10 delivering printed products such as newspapers to a pin conveyor 20 having pins 26 for pushing the printed products 28 in a conveying direction D. Pin conveyor is run at a generally constant speed by a drive motor 22, which speed can be input to a controller 50. A sensor 24 can sense if a printed product is missing or not located in front of a pin 26, and the controller 50 thus can determine the size of a gap, i.e. the number of missing printed products, in the product stream on conveyor 20.

The printed product stream enters a wrapping machine 30 which has a drive motor 32 controlled by controller 50 so that motor 32 can drive the wrapping machine 32 independently of the conveyor 20. If no gaps appear in the incoming product stream, the speed of motor 32 follows the speed of conveyor 20, as is known in the prior art. The wrapped products are collected in a stacker 40.

Figure 4:
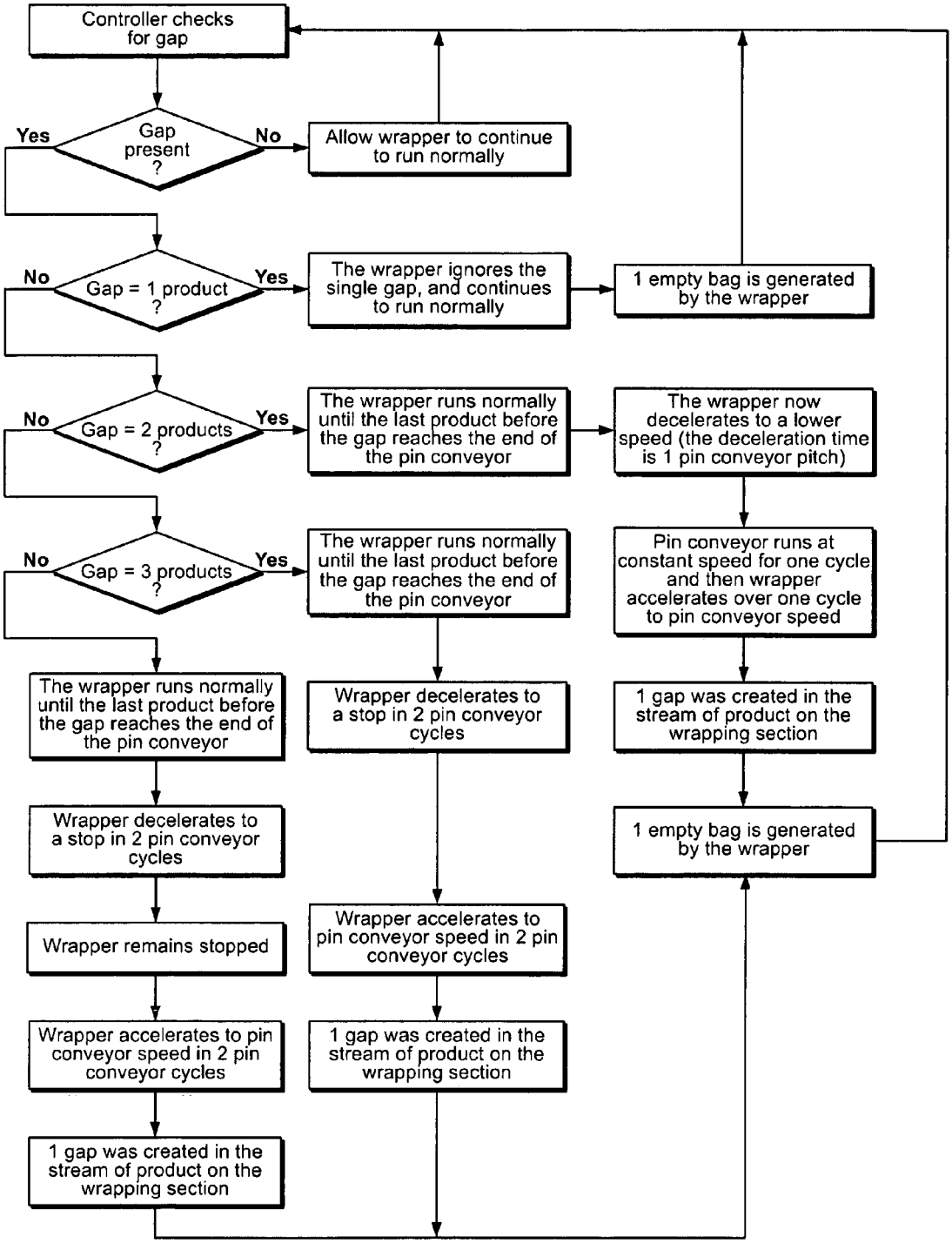
FIG. 4 shows a flow chart of one embodiment of the method of the present invention.

As shown in FIG. 4 with reference to one preferred method according to the present invention, controller 50 receives a signal from sensor 24 to determine whether a gap is present and the size of the gap. If the gap is not present the controller 50 drives the wrapping machine 30 to follow the conveyor 20.

If a gap is determined and its size is one missing product, the wrapper ignores the single gap and continues to follow the conveyor 20, so that one missing bag is generated. This single bag usually does not cause problems for the wrapping machine 30. The controller 50 then searches for new gaps in the product stream.

If the gap is two printed products, the controller may for example run wrapping machine 30 at the following speed until the lead end of the last product before the gap enters the wrapping machine 30, at which time the wrapping machine 30 controls the movement of the printed product. The wrapping machine 30 decelerates to a lower speed over a full product cycle of the pin conveyor (i.e. the time it takes one product at an instant of time to reach the position of its following product at that instant of time, i.e. the distance between two adjacent pins divided by the conveyor speed), and then accelerates back up to the conveyor speed over a full product cycle of the pin conveyor.

Figure 5:
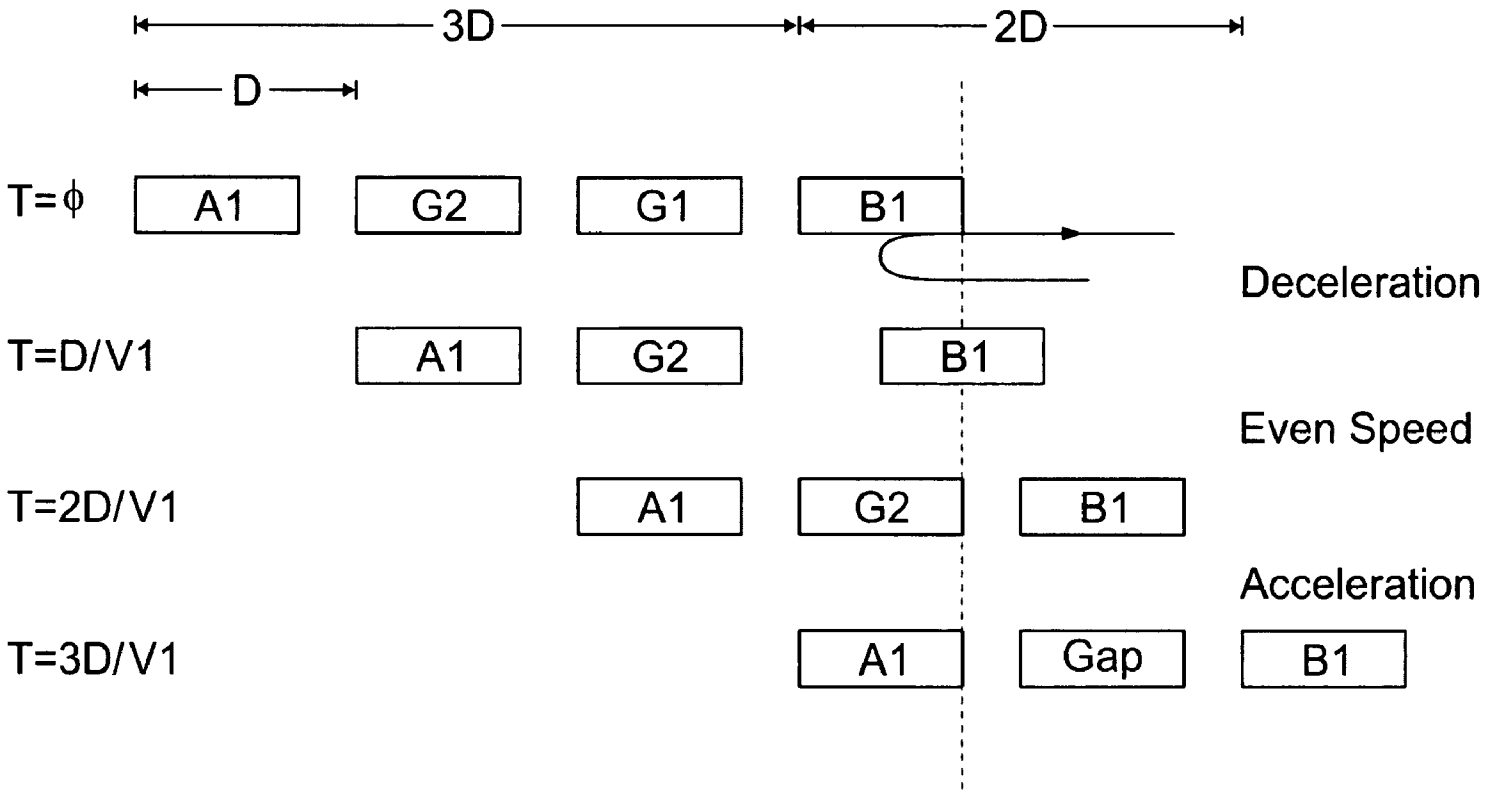
FIG. 5 shows a schematic of the method of the present invention when two gaps are in the incoming product stream and one gap is left in the wrapping machine.

FIG. 5 for example shows this routine. Products B1 and A1 with a gap G1, G2 travel at a speed V1. As product B1 enters the wrapping machine, the wrapping machine at speed V1 decelerates to another lower speed, and then accelerates back to the speed V1 so that a single product gap remains in the wrapping machine. Since B1 travels a distance of 2D (D being the distance between two pins in the conveyor) during this time 3D/V1, the average speed of the wrapping machine during this time may be two-thirds that of V1. For example at time T=D/V1, the speed can drop linearly to one-half V1 so that the average speed for this time is ¾*V1. For the time D/V1<T<2DV2, the speed can be a constant ½*V1, and for the last time section the speed can rise linearly back to V1, so that the average speed for this time is again ¾*V1. The overall average speed thus is two-thirds of V1.

Of course other control formulas could be used as long as the desired average speed is maintained. For example the wrapping machine slowed linearly over a time period T=3D/2V1 to a speed equal to ⅓ of V1 and sped up immediately again linearly over the second time period to time 3D/V1 back to speed V1.

Figure 6:
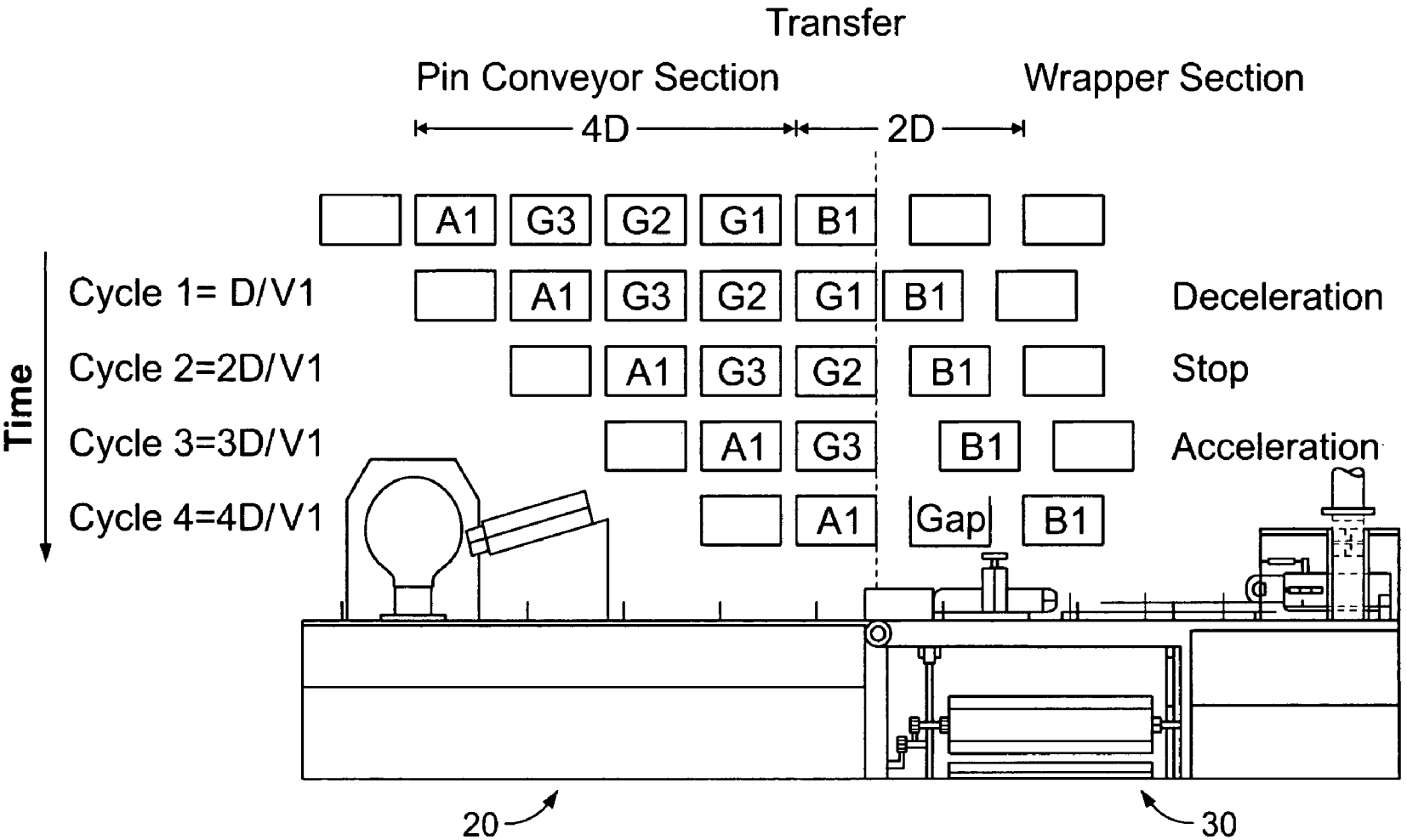
FIG. 6 shows a schematic of the method of the present invention when three gaps are in the incoming product stream and one gap is left in the wrapping machine.

As shown in FIG. 6 and described in FIG. 4, if the gap is three printed products, the wrapper runs at the pin conveyor speed until the printed product preceding the gap enters the wrapping machine at which point the wrapping machine decelerates to a stop over two pin conveyor cycles, i.e. a time equal to 2D/V1. The wrapping machine then may be accelerated back to pin conveyor speed V1 over the next two cycles.

Figure 7:
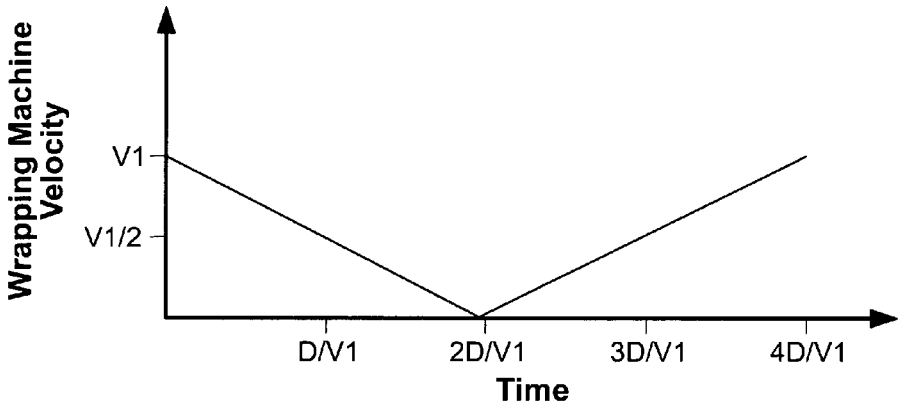
FIG. 7 shows one possible reduced acceleration control curve for wrapper velocity charted against time for reducing a three gap space to a single gap.

FIG. 6 shows the positions of the product B1 as it moves a distance 2D, while products A1 moves a distance 4D in the same time, so that gap G1, G2, G3 is reduced to a single product gap. FIG. 7 shows a possible control curve for the wrapping machine velocity over the time 4D/V1. At time 2D/V1, the wrapping machine stops, and at time 4D/V1 the machine is again at speed V1. The average speed for product B1 during the time 4D/V1 is one half of V1, so it is clear that product B1 has moved the distance 2D during time 4D/V1.

However, other velocity control curves are possible so long as at least one empty bag is created.

If more than three gaps are present, as indicated in FIG. 4, the wrapping machine may decelerate as in FIG. 7, remain stopped for a time equal to the size of the gap minus three spaces, divided by V1, and then accelerate as in FIG. 7. In other words, the wrapping machine may remain stopped for a period of time equal to (GS*D−3D)/V1, where GS is the gap size in terms of missing printing products, so that a single empty bag is created. However other control curves may be provided, including ones in which more than one empty bag is created.

Even further reduction in acceleration and deceleration forces is possible if the wrapping machine can reliably process a gap of two or more empty products. For example, for gaps of two products, two empty bags could be created for each incoming gap of two bags or more. However this does increase waste.

What is claimed is:

1. A method for controlling a wrapping machine for wrapping printed products in a bag comprising the steps of:

sensing a number of missing products in a printed product stream, the number of missing products defining an incoming gap, a size of the incoming gap being defined as the number of missing products; and controlling a speed of the wrapping machine when the incoming gap is sensed, the controlling step including intentionally leaving, in the printed product stream in the wrapping machine, at least a single product gap corresponding to the incoming gap;

operating the wrapping machine while the single product gap passes through the wrapper machine so as to create at least one empty bag.

2. The method as recited in claim 1 wherein the size of the incoming gap exceeds a predetermined size, the controlling step includes reducing the size of the incoming gap.

3. The method as recited in claim 1 wherein if the size of the incoming gap is a single product, the speed of the wrapping machine remains the same and a single empty bag is produced.

4. The method as recited in claim 1 wherein if the size of the incoming gap is two products and the wrapping machine is controlled to create a single empty bag in response to an incoming gap, the wrapping machine is decelerated to an intermediate speed and then accelerated to the incoming product stream speed.

5. The method as recited in claim 1 wherein if the size of the incoming gap is three products or more and the wrapping machine is controlled to create one empty bag in response to an incoming gap, the wrapping machine is decelerated to a stop in more than one pin conveyor cycle.

6. The method as recited in claim 5 wherein the wrapping machine is accelerated to the incoming product stream speed in more than one pin conveyor cycle.

7. The method as recited in claim 1 wherein the wrapping machine creates one empty bag corresponding to the incoming gap.

8. The method as recited in claim 1 wherein the wrapping machine creates two or more empty bags corresponding to the incoming gap.

9. A method for controlling a wrapping machine for wrapping printed products in a bag comprising the steps of:

sensing a number of missing products in a printed product stream having a first speed, the number of missing products defining a size of an incoming gap; and controlling a speed of the wrapping machine when the incoming gap is sensed, the controlling step including in certain modes decelerating the wrapping machine from the first speed over more than a full printed product stream cycle so as to reduce the size of the incoming gap; and operating the wrapping machine while the reduced-size incoming gap passes through the wrapping machine so that at least one empty bag is created.

10. The method as recited in claim 9 further comprising accelerating the wrapping machine to the first speed.

11. The method as recited in claim 9 wherein the size of the incoming gap is reduced in the wrapping machine to the size of exactly one printed product.

12. The method as recited in claim 9 wherein the wrapping machine is decelerated to a full stop when the size of the incoming gap is three printed products or more.

13. The method as recited in claim 9 wherein the wrapping machine is decelerated to a certain speed when the size of the gap is two printed products.

14. A method for controlling a wrapping machine for wrapping printed products in a bag comprising the steps of:

sensing a number of missing products in a printed product stream, the number of missing products defining an incoming gap, a size of the incoming gap being defined as the number of missing products; and controlling the speed of the wrapping machine when the incoming gap is sensed in certain modes so as to reduce the incoming gap in the wrapping machine; and operating the wrapping machine to create at least one empty bag in the wrapping machine.

* * * * *

UNITED STATES PATENT AND TRADEMARK OFFICE

CERTIFICATE OF CORRECTION

PATENT NO. : 6,971,217 B2 
DATED : December 6, 2005
INVENTOR(S) : Heiner Philipp Luxem and Richard Craig Meyer It is certified that error appears in the above-identified patent and that said Letters Patent is hereby corrected as shown below:

Column 3,
After line 48 insert -- An exemplary embodiment of the present invention is described below by reference to the following drawings, in which: --.

Signed and Sealed this

Eleventh Day of April, 2006

JON W. DUDAS
*Director of the United States Patent and Trademark Office*